US005158166A

United States Patent [19]

Barson

[11] Patent Number: 5,158,166

[45] Date of Patent: Oct. 27, 1992

[54] COIN DISCRIMINATION APPARATUS WITH COMPENSATION FOR EXTERNAL AMBIENT CONDITIONS

[75] Inventor: Andrew W. Barson, Stockport, England

[73] Assignee: Coin Controls Limited, London, England

[21] Appl. No.: 526,062

[22] Filed: May 18, 1990

[30] Foreign Application Priority Data

May 26, 1989 [GB] United Kingdom ..... 8912522

[51] Int. Cl.[5] ..... G07D 5/08

[52] U.S. Cl. ..... 194/319; 194/317; 324/225; 324/227

[58] Field of Search ..... 194/317, 318, 319; 324/225, 227, 236

[56] References Cited

U.S. PATENT DOCUMENTS 4,538,719 9/1985 Gray et al. ..... 194/317

4,754,862 7/1988 Rawicz-Szczerbo et al. ..... 194/319

*Primary Examiner*—F. J. Bartuska

*Attorney, Agent, or Firm*—Morgan & Finnegan

[57] ABSTRACT

A coin validator includes improved compensation circuitry for compensating for ambient conditions such as temperature or the presence of metallic objects, includes a path (1) for passage for coins under test, sensor coils (2, 3, 4) which form an inductive coupling with coins under test during their passage along the path, detectors (DM1, ADC) responsive to the impedance presented by the coil in the absence of a coin, for producing an ambient condition signal which is a function of an ambient condition such as temperature of the presence of metallic objects a controller (MPU 17) responsive to the inductive coupling between a coin travelling along the path past the coil, for providing signal which is a function of a characteristic of the coin, and a microprocessor (MPU) for modifying operation of the controller in dependence upon the ambient condition signal.

19 Claims, 2 Drawing Sheets

COIN DISCRIMINATION APPARATUS WITH COMPENSATION FOR EXTERNAL AMBIENT CONDITIONS

FIELD OF THE INVENTION

This invention relates to coin discrimination apparatus with improved compensation for ambient conditions such as temperature, which has particular but not exclusive application to a multi- coin validator.

BACKGROUND TO THE INVENTION

In a conventional multi-coin validator, coins pass along a path past a number of sensor coils which are each energised to produce an inductive coupling with the coin. The degree of interaction between the coin and the coil is a function of the relative size of the coin and coil, the material from which the coin is made and also its surface characteristics. Thus, by monitoring the change in impedence presented by each coil, data indicative of the coin under test can be provided. The data can be compared with information stored in a memory to determine coin denomination and authenticity.

UK Patent Specification 2 169 429 discloses coin discrimination apparatus utilising a plurality of inductive sensor coils which are each included in a respective resonant circuit. The resonant circuits are driven by a variable frequency oscillator through a multiplexer. As the coin passes a particular coil, the natural resonant frequency of the resonant circuit is altered due to the inductive coupling between the coin and the coil. The circuit is maintained at its natural resonant frequency by means of a phase locked loop which alters the frequency of the oscillator so as to track the natural resonant frequency of the resonant circuit during passage of the coin past the coil. As a result, the amplitude of the oscillatory signal developed across the resonant circuit varies substantially on a transitory basis. The amplitude deviation produced by the passage of the coin past the coil is a function of the coin denomination. It has been found that by using three coils of different sizes and configurations, three signals can be provided which uniquely characterise coins of a particular coin set e.g. the UK coin set.

The amplitude deviations produced by the three coils are digitised and compared with reference values stored in a programmable memory in order to discriminate between coins of different denominations. The "Sentinel" coin validator manufactured by Coin Controls Limited, the assignee hereof, operates in this manner.

It has been found that the amplitude deviations produced by a particular coin passing the various sensor coils, is a function of temperature and in our Sentinel validator, a thermistor is provided in each resonant circuit in order to compensate for temperature variations. Thus, the action of the thermistor is to render the amplitude deviation substantially invariant in respect to temperature.

The use of a thermistor, however, is only effective over a relatively narrow temperature range and furthermore increases the component count for the validator.

Also, it has been found that the presence or absence of metallic objects in the vicinity of the sensor coils can alter the calibration of the validator, as a result of inductive coupling between the metallic objects and the sensor coils.

SUMMARY OF THE INVENTION

In accordance with the present invention, the impedance of a sensor coil is used to provide an indication of an ambient condition such as temperature or the presence of absence of metallic objects, during periods when it is not being used to form an inductive coupling with a coin under test.

In accordance with the present invention there is provided coin discrimination apparatus comprising: means defining a path for passage of coins under test; sensor coil means for forming an inductive coupling with coins under test during their passage along the path; detecting means responsive to a parameter of the impedance presented by the coil in the absence of a coin, for producing an ambient condition signal which is a function of an ambient condition for the coil; control means responsive to the inductive coupling between a coin travelling along the path past the coil, for providing a signal which is a function of a characteristic of the coin; and compensating means for modifying operation of the control means in dependence upon the ambient condition signal.

Thus, in accordance with the invention, the impedance of the coil, in the absence of a coin, is utilised to provide an indication of ambient condition, and the resulting signal may be used to modify a coin signal produced in response to the inductive coupling between a coin under test and the coil.

The resulting modified signal may be compared with at least one set of reference data held in the memory, in order to determine coin authenticity and denomination.

The apparatus according to the invention can be used over a much wider temperature range than the prior art apparatus described hereinbefore, e.g. −20° C. to +70° C. Thus, the apparatus in accordance with the invention can be used for outdoor pay phones wherein substantial changes in temperature can occur.

Furthermore, the presence or absence of metallic objects in the vicinity of the validator will not degrade the coin acceptance calibration programmed into the apparatus, avoiding the need for screening.

Preferably, the apparatus includes a plurality of sensor coil means arranged for respectively forming an inductive coupling with a coin travelling along the path, and the detecting means is operative to produce ambient condition signals for the sensor coil means respectively. The apparatus may include means for producing an alarm signal if the ambient condition signals for the different sensor coil means fall outside of a predetermined relationship. Thus, for example, if the signals do not indicate that the coils are subject to the same ambient condition, it is possible that a fraud is being attempted by holding a coin at a stationary position within the apparatus.

The reference data held in the memory may include data defining a range of acceptable values for the coin signal, and the apparatus includes means for selecting the extent of the range in dependence upon the value of the ambient condition signal. In this way, the acceptance ranges or windows can selectively modified as a function of ambient condition e.g. temperature.

Conveniently, the apparatus includes a sensor coil for detecting that the coin, upon being found acceptable, passes to a predetermined accept path. Preferably, timing means are provided to determine if the accepted coin passes the accept coil within a predetermined minimum time from entering the apparatus, with a view to minimising frauds attempted by holding coins within the apparatus.

Preferably, the sensor coil means is connected in a resonant circuit exhibiting a resonant frequency which varies in dependence upon the inductive coupling between the sensor coil means and the coin under test during the passage of the coin along the path. Conveniently, variable frequency oscillator means are provided for energising the resonant circuit. Control means varies the frequency of the oscillator means such that it tracks the varying frequency of the resonant circuit during passage of the coin along the path past the sensor coil means. The coin signal is produced by amplitude responsive means, responsive to changes in amplitude of an oscillatory signal developed by the resonant circuit during the passage of the coin past the sensor coil means.

Preferably, the sensor coil means is connected in parallel with a capacitor in the resonant circuit, and the control means includes a phase locked loop.

The ambient condition signal can be produced by energising the sensor coil means periodically on a regular basis, or alternatively, this signal can be produced in response to a coin being inserted into the apparatus, so as to save power.

BRIEF DESCRIPTION OF THE DRAWINGS

In order that the invention may be more fully understood, an embodiment thereof will now be described by way of example with reference to the accompanying drawings, in which.

DETAILED DESCRIPTION

Figure 1:
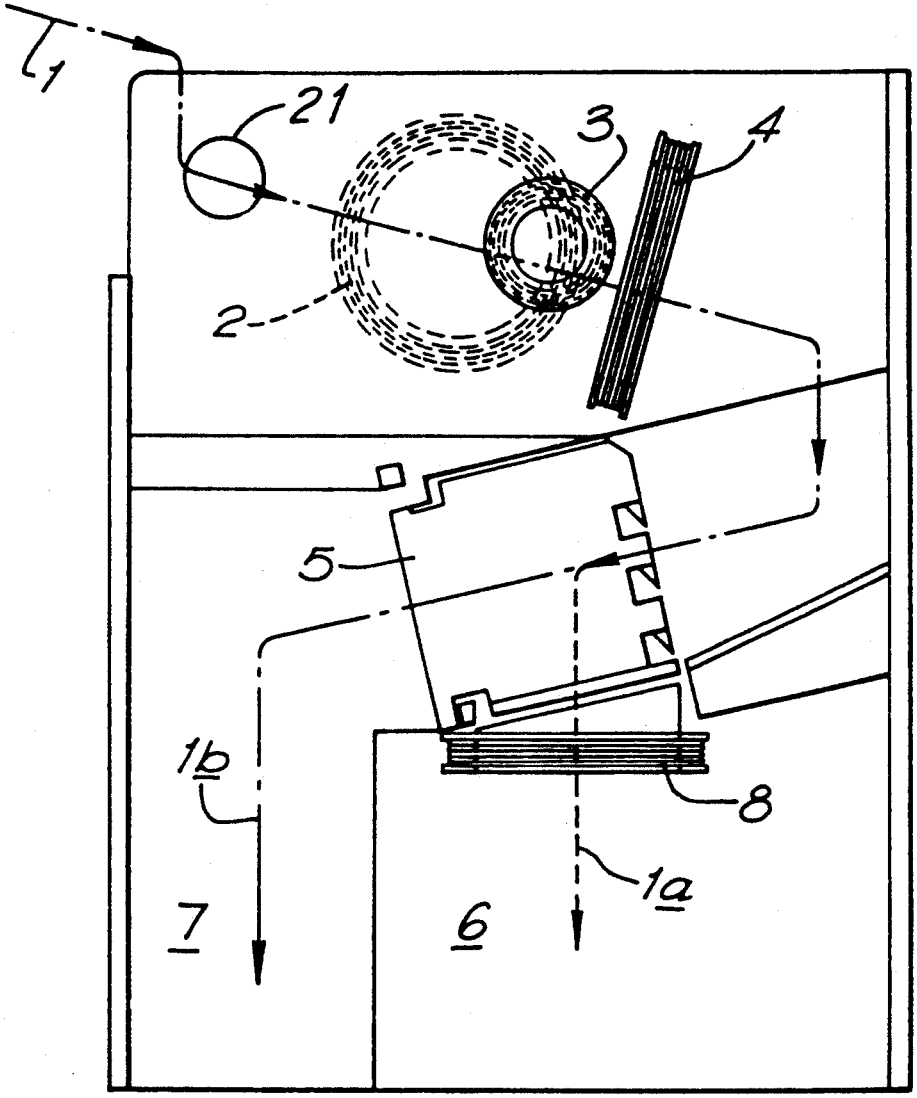
FIG. 1 is a schematic view of a multi-coin validator in accordance with the invention.

Referring to FIG. 1, the apparatus consists of a coin path 1 along which coins under test roll edgewise past first, second and third sensor coils 2, 3, 4. If the coin detected by the sensor coils is identified as a true coin, a solenoid operated accept gate 5 is opened to allow the coin to pass along path 1*a* down an accept chute 6. If the coin is identified to have non-acceptable characteristics, e.g. a counterfeit coin, the gate 5 is not opened and the coin passes along path 1*b* to reject shute 7.

An accept coil 8 is provided in the accept shute 6, which is energised in such a manner as to detect the presence of acceptable coins.

Referring to FIG. 1, the sensor coils 2, 3 are disposed on opposite sides of the coin path 1 and the coil 4 is arranged to wrap around the path such that its axis is parallel to the length thereof. The three coils are energised at different but relatively close frequencies F1, F2, F3 in the KHz range. As explained in more detail in our specification 2 169 429, this coil geometry and frequency arrangement permits an improved discrimination between coin denominations and counterfeit coins.

Figure 2:
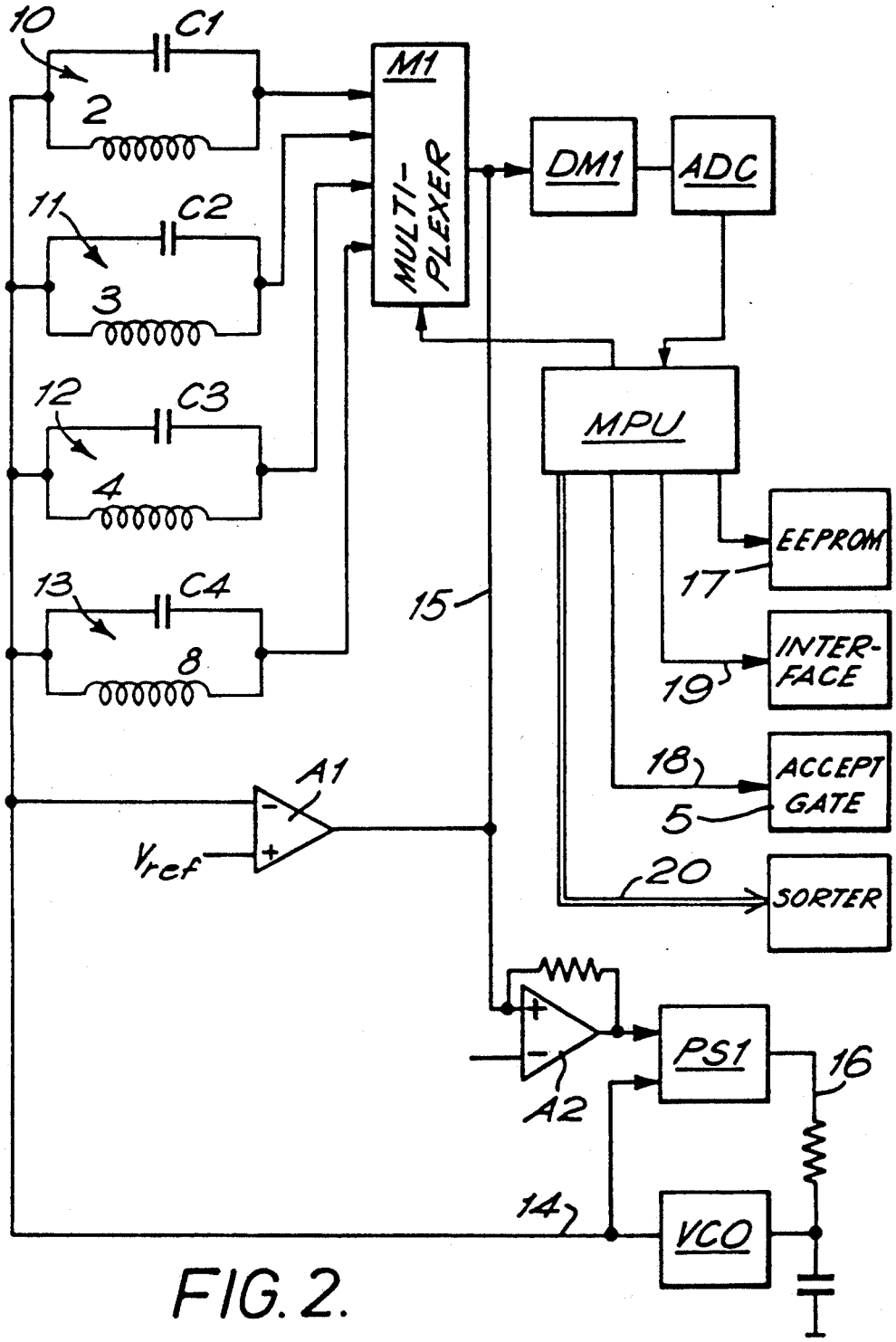
FIG. 2 is a schematic circuit diagram of discrimination circuitry connected to the sensor coils shown in FIG. 1.

As shown in FIG. 2, the coils 2, 3, 4 and 8 are each connected in a respective parallel resonant circuit 10 to 13 containing capacitors C1 to C4. Each of the resonant circuits 10 to 13 has its own natural resonant frequency when no coins are in proximity to the coils 2, 3, 4. Each of the resonant circuits 10 to 13 is driven by a phase locked loop at its own natural resonant frequency by means of a voltage controlled oscillator VCO which produces an oscillatory drive signal on line 14. The resonant circuits 10 to 13 are sequentially connected in a feedback path to an operational amplifier A1 via a multiplexer M1. The output of the multiplexer on output line 15 is inverted by amplifier A2 and the resulting signal is compared in the phase comparator PS1 with the output of the voltage controlled oscillator VCO on line 14. The output of the phase comparator PS1 comprises a control voltage on line 16 which is used to control the frequency of the voltage controlled oscillator VCO. The phase locked loop maintains 180° phase difference across the amplifier Al which is the required condition to maintain the selective resonant circuit at its natural resonant frequency.

The multipler M1 is controlled by a microprocessor MPU to switch the resonant circuits 10 to 13 into the feedback path of amplifier A1.

In the absence of a coin, the apparatus operates in an idle mode in which the microprocessor causes the multiplexer Ml to switch the resonant circuits 10 to 13 sequentially into the feedback path of amplifier Al, such that the circuits 10 to 13 produce sequentially on line 15 an output at a respective substantially constant frequency and amplitude, determined by the parameters of the resonant circuit concerned and also the ambient temperature of the sensor coil therein, as will be explained in more detail hereinafter.

Figure 3:
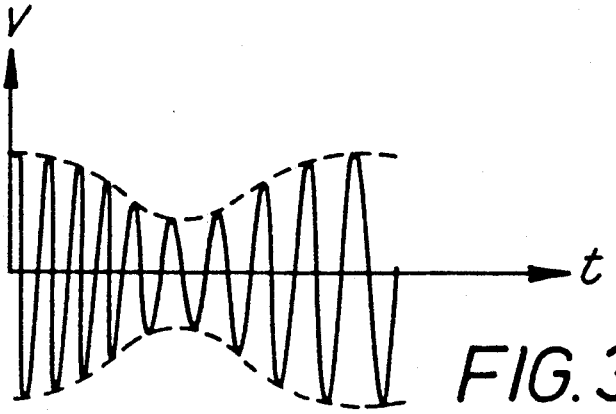
FIG. 3 is a graph showing how the frequency and amplitude of the oscillation produced on line 15 in FIG. 1 deviates with time.

When a coin enters the coin path 1, the apparatus is switched from the idle mode to a coin sensing mode in which characteristics of the coin are detected. Considering for example, the case of resonant circuit 10, when a coin rolls past the coil 2, an inductive coupling is formed between the coil 2 and the coin such that the impedance presented by the coil to the resonant circuit is modified. Consequently, both the frequency and amplitude of the oscillation produced on line 15 deviates with time substantially as shown in FIG. 3. The change in impedance occurs by virtue of skin effect type eddy current being induced by the coil in the coin. The magnitude of the frequency and amplitude deviations are dependent upon the relative sizes of the coil and the coin, the coin diameter and thickness, the metal from which the coin is made and the surface pattern embossed on the coin. Thus, as the coin passes the coil 2, there is a transitory deviation of the natural resonant frequency for the resonant circuit 10. The phase comparator PS1, the inverting amplifier A2 and the voltage controlled oscillator VCO operate as a phase locked loop to maintain the drive frequency on line 14 at the resonant frequency for the circuit 10. Thus, the frequency of the oscillator VCO is caused to track the transistory change in resonant frequency of the circuit 10. As a result, the output from the resonant circuit on line 15, as the coin passes the coil 2, deviates substantially in amplitude mainly in accordance with the change in resistive component of the sensing coil impedance. This amplitude deviation is used as a parameter indicative of the size, metallic content and the embossed pattern on the coin.

The oscillatory signal on line 15 is demodulated by demodulator DM1 and digitised by an analogue to digital converter circuit ADC. The analogue to digital converter operates repetatively so as to sample the signal on line 15 and store in the microprocessor MPU signals indicative of the peak deviation of amplitude as the coin passes the coil 2.

The coin then passes from coil 2 to coil 3 and the microprocessor MPU switches the multiplexer Ml so that the process is repeated for the coil 3. The process is thereafter repeated for coil 4.

The resonant circuit 13 which includes the accept coil 8, is utilised to ensure that the coin, if accepted, passes to the accept chute 6.

As explained in our UK Patent Specification 2 169 429, a substantially unique set of amplitude deviations produced by the circuits 10, 11, 12 characterise the coin denomination. Sets of digital values which characterise acceptable values of these amplitude deviations for different coin denominations are stored in an EEPROM 17 in order to be compared by the microprocessor MPU with the values produced by the analogue to digital converter ADC for an actual coin under test. If the microprocessor determines the presence of an acceptable coin, it provides an output on line 18 to open a solenoid operated accept gate 5.

The microprocessor MPU may produce on line or lines 19 an output indicative of acceptance of a coin of a particular denomination, for further processing. Also, an output may be provided on line 20 to operate a coin sorter for discriminating between coins of different denominations detected by the device.

Thus, from the foregoing, it will be seen that by monitoring the change in impedance of the coils 2, 3, 4, a set of digital signals are provided to the microprocessor MPU which uniquely characterise the coin under test. The impedance of the sensor coils 2, 3, 4 each consist of a "real" (resistive) and an "imaginary" (inductive) component. As explained in UK Patent Specification 2 169 429, the arrangement described with reference to FIG. 2 monitors primarily the change in the resistive component of the impedance produced by passage of the coin.

In accordance with the invention, it has been appreciated that the resistive component of the coil impedance, in the absence of a coin, is a function of temperature. The coils 2, 3, 4 are typically made of copper wire the resistance of which varies substantially linearly with temperature. Thus, the output on line 15, for each coil 2, 3, 4, during the idle mode i.e. in the absence of a coin, constitutes a ambient condition signal for the coil indicative amongst other things of its temperature. These coil temperature signals produced in the idle mode are demodulated by demodulator DM1 and digitised by analogue to digital converter ADC, and fed to the microprocessor MPU. The peak amplitude deviations signals produced by passage of a coin past the coils 2, 3, 4 vary in amplitude as a function of temperature and accordingly, temperature compensation needs to carried out in order that the values thereof can be compared with the stored information in EEPROM 17.

In accordance with the invention, the temperature signals produced during the idle mode stored in microprocessor MPU are used to modify the peak amplitude deviation signals (referred to herein as coin signals) to compensate for the effects of temperature.

The following algorithm is used on the coin signals for the coils 2, 3, 4 respectively.

$$y=k((c_1x+c_2)t+x)+c_3 \quad (1)$$

where y = temperature compensated coin signal
x = uncompensated coin signal
t = coil temperature signal
k, $c_1$, $c_2$, $c_3$ = constants In the foregoing, constants k, $c_1$, $c_2$ and $c_3$ are stored in the EEPROM 17 and a different set thereof are used for each of the coils 2, 3, 4 respectively.

The temperature signal t for each coil comprises the value of the signal produced on line 15 during the idle mode for the particular coil. The temperature signal may itself be normalised by the microprocessor MPU in relation to a datum value thereof stored in the EEPROM which is produced at a particular reference temperature during setting up of the apparatus in a factory. This reference temperature corresponds to the temperature at which the coin acceptance values stored in the EEPROM are produced.

Thus, in use, a temperature signal t is produced for each coil during the idle mode, which is digitised by converter ADC and fed to the microprocessor MPU. Then, in the coin sensing mode, as a coin passes the coils 2, 3, 4, uncompensated coin signals x are developed in the microprocessor MPU for the coils 2, 3, 4 respectively. Temperature compensated coin signals y are then computed by the microprocessor MPU in accordance with equation 1 above for the coils respectively. The resulting temperature compensated signals y can then be compared with the coin acceptance values stored in the EEPROM 17. It will be appreciated that the coin acceptance values stored in the EEPROM are in effect indicative of acceptable values at a particular reference temperature, and the effect of operation of equation 1 is to modify the coin signals x into corresponding values y which correspond to the reference temperature, thereby rendering the values y suitable for comparison with the stored coin acceptance values, substantially irrespective of the temperature at which the signal y were produced. Thus, the effects of temperature on the amplitude of the signals from the resonant circuits 10, 11, 12 are fully compensated.

The apparatus according to the invention has the advantage that it can operate over a much wider temperature range and thus can be used in situations where the coin validator is used outside, for example in a coin operated telephone, which is subject to wide temperature changes.

Also, it has been found that the coil temperature signals are a function of other ambient conditions, i.e. not only temperature. Thus, the output on line 15, for each coil 2, 3, 4 during the idle mode, i.e. in the absence of a coin is a function of ambient conditions such as the presence or absence of metallic objects in the vicinity of the coils. It has been found according to the invention compensation for such metallic objects is achieved by applying the algorithm shown as equation (1) as described previously.

This has the advantage that the apparatus according to the invention can be used in a metal housing as may be required for a pay phone without the need for special screening for the sensor coils, or the need for special calibration for each individual metal housing and validator installation.

The coin acceptance data stored in EEPROM 17 is arranged to define acceptance ranges or windows. Thus, the particular value of a temperature compensated coin signal y lies within a range Y1 to Y2 it is considered acceptable. In accordance with the invention the upper and lower limits of the acceptance range Y1, Y2 can varied in accordance with temperature. Thus, the coil temperature signal t can be used to select different stored values of Y1 and Y2 in dependence upon temperature. Alternatively reference values of Y1 and Y2 stored in the EEPROM can be modified according to a predetermined algorithm in dependence upon the value of the temperature signal t.

When a coin validator is used in a telephone, a commonly attempted fraud is to lodge a coin in the coin entrance passageway with a view to obtaining additional telephone call credits. In the present apparatus it is possible to detect such a coin lodged in the passageway 1 by detecting whether the coil temperature signals t for the coils 2, 3, 4 during the idle mode fall within a predetermined relationship. If a coin is lodged in the passageway, at least one of the reference readings will be continuously modified from the value thereof that would occur in the absence of a coin. Thus, the microprocessor MPU desirably includes an algorithm which checks the relationship of the coil temperature signals to ensure that they fall within a predetermined relationship with one another in order to detect such frauds.

Also, the microprocessor MPU may programmed to monitor the time taken for the coin to pass the last sensor coil 4 and arrive at the accept coil 8. Thus, if the coin is detected to be of an acceptable denomination, the microprocessor sets a predetermined minimum time for the coin to pass from the coil 4 to coil 8. If the coin takes less than the minimum time, there is a possibility that fraud is being attempted. The system can also set a maximum time for the coin to pass from coil 4 to coil 8.

In the foregoing embodiment, the temperature signals are derived during an idle mode. However it is possible to operate the apparatus without an idle mode wherein an additional "wake-up" sensor 21 is provided to detect when a coin is inserted into the passageway 1. The coils 2, 3, 4 are then individually energised for short periods, in the absence of the coin, to obtain the coil temperature signals t prior to interaction of the coin with the coils. The coin then rolls down the path 1 so as to interact with the coils 2, 3, 4 as described above in relation to the coin sensing mode.

Also, whilst in the described embodiment, the impedance of the sensor coils is detected by means of a phase locked loop, it would be possible to utilise other means to detect the change in coil impedance, for example by detecting frequency.

I claim:

1. Coin discrimination apparatus comprising:

means defining a path for passage of a coin under test;

sensor coil means for forming an inductive coupling with said coin under test during its passage along the path;

drive means for generating an oscillatory electrical signal across the coil sensor means;

detecting means responsive to the amplitude of the oscillatory signal across the sensor coil means in the absence of a coin, for producing an ambient condition signal (t) which is a function of an ambient condition for the sensor coil means;

control means responsive to the amplitude deviation of the signal across the sensor coil means produced as a result of the inductive coupling between a coin traveling along the path past the sensor coil means, for providing a coin signal (x) which is a function of a characteristic of the coin uncompensated for the effects of said ambient condition;

compensating means for modifying the coin signal (x) to produce a compensated coin signal (y) according to the following equation:

$$y=k((c_1x+c_2)t+x)+c_3$$

where k, $c_1$, $c_2$, $c_3$ are constants;

memory means including at least one set of reference data for said compensated coin signal (y); and means for determining whether the compensated coin signal (y) is in a predetermined relationship with said reference data and providing an output indicative of whether the coin is acceptable.

2. Apparatus according to claim 1 wherein said output signal is indicative of coin denomination.

3. Apparatus according to claim 1 wherein a plurality of said sensor coil means are arranged for respectively forming an inductive coupling with a coin travelling along a path, and the detecting means is operative to produce ambient condition signals for the coils respectively.

4. Apparatus according to claim 3 including means for producing an alarm signal if the ambient condition signals fall outside of a predetermined relationship.

5. Apparatus according to claim 1 wherein said reference data includes data for defining a range of acceptable values for the coin signal, and including means for selecting the extent of the range in dependence upon the value of the ambient condition signal.

6. Apparatus according to claim 1 including an accept gate operated in response to said output signal and an accept coil responsive to passage of a coin past the accept gate, and including timing means for determining whether an acceptable coin passes from the sensor coil means to the accept coil within the predetermined minimum time.

7. Apparatus according to claim 1 wherein said ambient condition comprises temperature.

8. Apparatus according to claim 1 wherein said sensor coil means is connected in a resonant circuit exhibiting a resonant frequency which varies in dependence upon the inductive coupling between the sensor coil means and the coin under test during passage of the coin along the path; variable frequency oscillator means for energising said resonant circuit; control means for varying the frequency of the oscillator means such that it tracks the varying resonant frequency of the resonant circuit during passage of the coin along the path past the sensor coil means; and amplitude responsive means responsive to changes in amplitude of an oscillatory signal developed by the resonant circuit during said passage of the coin past the sensor coil means, whereby to provide said coin signal.

9. Apparatus according to claim 8 wherein said sensor coil means is connected in parallel with the capacitor in said resonant circuit, and said control means includes a phase locked loop.

10. Apparatus according to claim 9 including demodulator means for demodulating said oscillatory signal, and analogue to digital converter means for successively producing digitised sample values of the demodulated signal.

11. Apparatus according to claim 10 including microprocessor means responsive to said digitised sample values to determine the peak deviation of amplitude of the demodulated signal as the coin passes the sensor coil means, whereby to derive said coin signal.

12. Apparatus according to claim 11 wherein the output of said analogue to digital convertor, in the absence of a coin constitutes said ambient condition signal.

13. Apparatus according to claim 12 wherein said microprocessor means is operative to modify said coin signal in accordance with said ambient condition signal to produce a condition compensated coin signal.

14. Apparatus according to claim 13 wherein said microprocessor means is arranged to compare the condition compensated coin signal with a plurality of predetermined values thereof programmed into said memory.

15. Apparatus according to claim 14 wherein said predetermined values are defined by upper and lower limits stored in the memory.

16. Apparatus according to claim 15 wherein said upper and lower limits are selectively modified in accordance with said ambient condition signal.

17. Apparatus according to claim 8 wherein said sensor coil means includes a plurality of sensor coils each connected in a respective said resonant circuit, and including multiplexer means for connecting said resonant circuits sequentially to said amplitude responsive means.

18. Apparatus according to claim 1 including coin entry detection means for detecting the insertion of a coin into the passageway, means for energising the sensor coil means in the absence of said coin to produce said ambient condition signal immediately prior to passage of the coin past the coils.

19. Apparatus according to claim 1 wherein said ambient condition includes the presence or absence of metallic objects in the vicinity of the sensor coil means.

* * * * *